US005653546A

United States Patent [19]

Cronkhite et al.

[11] Patent Number: 5,653,546

[45] Date of Patent: Aug. 5, 1997

[54] CONNECTOR ASSEMBLY

[75] Inventors: Carol M. Cronkhite; Jeff A. Trupe, both of Shakopee, Minn.

[73] Assignee: The Fence Connection, L.L.C., Savage, Minn.

[21] Appl. No.: 176,627

[22] Filed: Jan. 3, 1994

[51] Int. Cl.[6] ..... F16C 11/06

[52] U.S. Cl. ..... 403/87; 403/77; 403/123; 256/65; 256/67; 256/68; 43/98; 248/219.3; 248/225.11

[58] Field of Search ..... 256/10, 67, 65, 256/68, 69, 60, 50, 47, 48, 56, 59, 66; 403/53, 57, 123, 87, 90, 114, 113, 76–77; 248/219.3, 218.4, 231.6, 231.3, 225.11, 289.11; 43/124, 98; 52/101

[56] References Cited

U.S. PATENT DOCUMENTS

| | | | |
|---|---|---|---|
| 57,073 | 8/1866 | Bettis . | |
| 266,988 | 11/1882 | Gleason . | |
| 895,297 | 8/1908 | Peter | 256/67 X |
| 961,981 | 6/1910 | Miller . | |
| 961,982 | 6/1910 | Miller . | |
| 1,880,423 | 10/1932 | Eddy . | |
| 2,854,261 | 9/1958 | Spaide | 287/2 |
| 3,053,351 | 9/1962 | Fulcher | 189/2 |
| 3,092,407 | 6/1963 | Blonder | 256/65 X |
| 3,346,280 | 10/1967 | Pfaff, Jr. et al. | 287/14 |
| 3,347,572 | 10/1967 | Pfaff, Jr. et al. | 287/14 |
| 3,370,836 | 2/1968 | Ashworth et al. | 256/65 X |
| 3,484,827 | 12/1969 | Hall . | |
| 3,524,627 | 8/1970 | Boyanton et al. | 256/65 |
| 3,711,066 | 1/1973 | Niemiec . | |
| 3,767,236 | 10/1973 | Horgan, Jr. | 403/73 |
| 3,960,367 | 6/1976 | Rogers | 256/65 X |
| 3,993,289 | 11/1976 | Lewis et al. | 256/59 |
| 4,006,564 | 2/1977 | Wiese | 256/65 X |
| 4,077,611 | 3/1978 | Wilson | 256/10 |
| 4,150,907 | 4/1979 | Thurnauer | 256/67 X |
| 4,155,590 | 5/1979 | Cunningham | 403/87 X |
| 4,181,293 | 1/1980 | Laribee . | |
| 4,208,038 | 6/1980 | Reid | 256/65 |
| 4,239,414 | 12/1980 | Williamson | 403/387 |
| 4,365,488 | 12/1982 | Mochida et al. | 403/57 X |
| 4,464,073 | 8/1984 | Cherry . | |
| 4,471,947 | 9/1984 | Osborne | 256/24 |
| 4,526,348 | 7/1985 | Cammack . | |
| 4,616,950 | 10/1986 | Morris . | |
| 4,620,813 | 11/1986 | Lacher | 403/93 |
| 4,688,769 | 8/1987 | Smrt | 256/65 |
| 4,702,459 | 10/1987 | Moschner | 256/19 |
| 4,722,514 | 2/1988 | Pettit | 256/50 |
| 4,767,232 | 8/1988 | Francis . | |
| 4,792,122 | 12/1988 | Smrt | 256/68 |
| 4,801,128 | 1/1989 | Taylor | 256/68 |
| 4,889,322 | 12/1989 | Wagner | 256/36 |
| 4,923,176 | 5/1990 | Heinz | 256/65 |
| 4,979,724 | 12/1990 | Williams | 256/36 |
| 4,986,513 | 1/1991 | Schultz et al. . | |
| 5,026,028 | 6/1991 | Ooi et al. . | |
| 5,046,705 | 9/1991 | Williams | 256/36 |
| 5,061,109 | 10/1991 | Miller . | |

(List continued on next page.)

FOREIGN PATENT DOCUMENTS

| | | | |
|---|---|---|---|
| 584560 | 2/1925 | France | 256/67 |
| 2248599 | 10/1990 | Japan . | |
| 572556 | 2/1976 | Switzerland | 256/67 |
| 410825 | 5/1934 | United Kingdom | 403/90 |
| 934191 | 12/1963 | United Kingdom | 403/90 |
| 2269837 | 8/1993 | United Kingdom . | |

*Primary Examiner*—Randolph A. Reese
*Assistant Examiner*—Heather Shackelford
*Attorney, Agent, or Firm*—Moore & Hansen

[57] ABSTRACT

A connector assembly connects two rails to a T-post. The connector assembly includes a first and second connector configured to receive the rails, and a mounting member attached to the T-post for pivotally mounting the first and second connectors to the T-post about a plurality of axes. The connector assembly includes a locking mechanism for interlocking the first and second connector with the mounting member. The connector assembly also includes a lock for securing the mounting member to the T-post.

65 Claims, 10 Drawing Sheets

U.S. PATENT DOCUMENTS 5,152,507 10/1992 Lee ..... 256/13.1
5,161,783 11/1992 German .
5,163,658 11/1992 Cleveland .
5,192,055 3/1993 Griggs et al. ..... 256/DIG. 5 X
5,199,218 4/1993 McQuade .
5,230,187 7/1993 Reimann ..... 52/102
5,238,321 8/1993 Jarjoura ..... 403/172
5,255,899 10/1993 von Grozny ..... 256/59
5,277,408 1/1994 Parker ..... 256/65
5,286,129 2/1994 French et al. ..... 403/323 X
5,362,030 11/1994 Iler, Jr. et al. ..... 256/65
5,383,739 1/1995 Haglund ..... 403/107

CONNECTOR ASSEMBLY

FIELD OF INVENTION

This invention relates to a connector assembly suitable for pivotally connecting two members, such as the rails of a fence, to a T-post about a plurality of axes.

BACKGROUND OF THE INVENTION

Fences are used in a variety of applications, such as farming, riding rings, and landscaping. Fences are made of many materials, including wood, plastic and wire. The fencing is then attached to a post which is driven into the ground to secure the fence in place. The posts are typically made of either metal or wood, depending on the type of fencing used.

Fences are primarily used in outdoor settings. Accordingly, the posts must be inserted into the ground. In order to install wooden posts, a hole must be dug into the ground. The hole must be appropriately sized to receive the post. Such a hole may be dug with a handtool or shovel. Wooden posts, however, are typically at least 4" by 4" in size, and thus, require a substantial size hole. The time and labor necessary to dig such a hole can be extensive. Consequently, such holes are often dug with a powered auger. However, due to the size and depth of the hole needed to house such posts, it is not uncommon to encounter rocks. Rocks can shear the blades of the auger or clog the machine, rendering it inoperable.

In addition, since fences are generally used outdoors, they must be able to withstand the effects of the weather. In colder climates, frost continually causes the posts to shift out of the ground. The effects of frost heave can be avoided by digging a deep hole having a depth of 30 to 35 inches deep. Deep holes are also desirable since they provide further support to the posts for fences used to enclose animals. The deeper the hole, however, the greater the risk of uncovering rocks, and thus more time, and labor is necessary to dig.

Wooden posts also have limited versatility. Wooden rails are currently attached to wooden posts by nailing them to the posts. As a result, the rails are permanently mounted in one position. The terrain on which fences are used, however, is typically uneven. Therefore, the rail must be customized to accommodate the contour of the land. For example, the ends of the rails may need to be cut at an angle to accommodate the sloping nature of the ground. In addition, nailing the rails to the post may cause them to split with the grain of the wood.

While inserting wooden posts at greater depths helps increase the sturdiness of the fence, the posts themselves are quite rigid. As a result, when force is applied to such posts, such as by animals, they often break. In the case where the fence is being used to contain animals, the broken posts must be replaced immediately to prevent animals from escaping. As a result, fences using such posts require continuous monitoring and maintenance.

A further disadvantage with wooden posts is that they are expensive. Wooden posts can cost at least two-to-three times as much as their metal counterparts. The fact that they must often be replaced further adds to the "cost." In the case of fencing systems covering large areas of land, such costs can be prohibitive.

In light of the disadvantages associated with fences using wooden posts, people often resort to T-posts (i.e., metal posts), as an alternative. T-posts have several advantages over wooden posts. To begin with, T-posts are much smaller than wooden posts. A typical T-post is approximately 1½"× 1½" in size. As a result, the hole required to receive the T-post is also smaller.

In addition, T-posts are considerably stronger than wooden posts, and thus are less prone to break. As a result, they rarely need to be replaced. They also are not subject to the ill effects of frost heave. As a result, the depth of the hole for receiving the post is approximately half that required for wooden posts.

A further advantage of T-posts is that the hole need not be dug. Rather, T-posts are driven into the ground with a post driver. This feature not only drastically reduces the amount of time required to install the post, but also makes their installation virtually effortless.

Another advantage of T-posts is that they are more flexible. Due to the malleability of the metal, when forces are applied to the post, the post bends. Therefore, instead of having to be replaced, it can be repaired by merely bending the post back to its original position. This capability further reduces the costs associated with this alternative.

One major disadvantage with T-posts, however, is that currently they can only be used to connect wire fencing. Wire fences, however, are not aesthetically pleasing. In fact, in the case of landscaping, where aesthetics is of the utmost importance, such fences are unacceptable. Wire fences are also very dangerous, especially when used as a means for containing animals. Animals often have a hard time seeing the wire, especially at night. As a result, they get entangled in the fence, often severely maiming them. In the case of show or racing animals, where the health and physical appearance of the animal is of utmost importance, such a consequence is unacceptable. Depending on the extent of the injury, the animal may no longer be able to be shown or raced. In some cases, the injury can permanently put the animal out of commission.

Accordingly, there is a need for a connector assembly which connects non-wire rails to a T-post so that the advantages of both may be obtained in one fence system. In particular, there is a need for a connector assembly in which the rails may be pivotally mounted about a plurality of axes with respect to the T-post. With such a connector assembly, a safe and sturdy fence system which is relatively inexpensive, is easy to install, and can be used in a variety of applications may be achieved.

SUMMARY OF THE INVENTION

The present invention relates generally to a connector assembly suitable for pivotally connecting two members, such as the rails of a fence, to a T-post. The assembly has three major components; namely, a first connector, a second connector, and a mounting member attached to the T-post for pivotally mounting the first and second connectors to the T-post about at least one axis. Preferably, the mounting member permits the first and second connectors to pivot about a horizontal and a vertical axis, but not about the longitudinal axis of the rail.

Each connector includes a rail-receiving portion at one end configured to receive the rails. Each connector also preferably includes a C-shaped portion for attaching to the mounting member. The mounting member includes a stem having a channel formed therein shaped to receive the T-post, and a center member projecting from the stem and configured to frictionally engage the C-shaped portions of the first and second connectors with the center member. The center member of the mounting member preferably has a surface with a substantially spherical curvature.

Each of the C-shaped portions of the first and second connectors includes a top section having an inner and outer surface and bottom section having an inner and outer surface, the inner and outer surfaces of the top and bottom sections each having a curvature which is substantially the same as the curvature of the center member of the mounting member. When assembled, the top section of the second connector is held between the top section of the first connector and the center member, and the bottom section of the first connector is held between the bottom section of the second connector and the center member.

The mounting member also preferably includes a locking mechanism configured to interlock the C-shaped portions of the first and second connectors with the center member of the mounting member. The locking mechanism includes a bolt, and a bore defined by the center member of the mounting member and adapted to receive the bolt. The top and bottom sections of the C-shaped portions of the first and second connectors each define a centrally located elongated slot adapted to receive the bolt. A washer is preferably included between the head of the bolt and the top section of the C-shaped portion of the outermost connector.

The connector assembly also preferably includes a lock for securing the mounting member to the T-post. The lock includes a body having an inner cavity formed therein shaped to receive the T-post, and an outer contour configured to fixedly engage the stem of the mounting member. The connector assembly may also include a means for carrying an electrifiable fence wire for providing electricity to the fence.

Another embodiment of the present invention relates to a connector assembly suitable for connecting one rail to a T-post. The connector assembly has two major components; namely, a connector, and a mounting member attached to the T-post for pivotally mounting the connector to the T-post about at least one axis. Preferably, the mounting member permits the connector to pivot about a horizontal and a vertical axis, but not the longitudinal axis of the rail.

The connector includes a rail-receiving portion at one end configured to receive the rail. The connector also preferably includes a C-shaped portion for attaching to the mounting member. The mounting member includes a stem having a channel formed therein shaped to receive the T-post, and a center member projecting from the stem and configured to frictionally engage the C-shaped portion of the connector with the center member. The center member of the mounting member preferably has a surface with a substantially spherical curvature. The C-shaped portion of the connector includes an inner surface having a curvature substantially the same as the curvature of the center member of the mounting member. When assembled, the inner surface of the C-shaped portion of the connector surrounds the surface of the center member of the mounting member.

The mounting member also preferably includes a locking mechanism configured to interlock the C-shaped portion of the connector with the center member of the mounting member. The locking mechanism includes a bolt, and a bore defined by the center member of the mounting member and adapted to receive the bolt. The C-shaped portion of the connector has a top and bottom section, the top and bottom sections each defining a centrally located elongated slot adapted to receive the bolt.

The connector assembly may also include a lock for securing the mounting member to the T-post. The lock includes a body having an inner cavity formed therein and shaped to receive the T-post, and an outer contour configured to attach to the stem of the mounting member. The connector assembly may also include a means for carrying a fence wire for providing electricity to the fence.

Yet another embodiment of the invention relates to a connector assembly for connecting either one or two rails to a T-post. The connector assembly has three major components; namely, a connector, a mounting member, and a washer. The connector includes a rail-receiving portion at one end, and a C-shaped portion at the other end, having a top section and a bottom section. The mounting member attaches to the T-post and pivotally mounts the C-shaped portion of the connector to the T-post about at least one axis. Preferably, the mounting member permits the connector to pivot about a horizontal and a vertical axis, but not a longitudinal axis. The mounting member also includes a stem having a channel formed therein and shaped to receive the T-post, and a center member projecting from the stem and having a surface with a substantially spherical curvature. The washer has a top surface and a bottom surface, each having a curvature substantially the same as the curvature of the center member. When assembled, the washer is held between the center member of the mounting member and the top or bottom section of the C-shaped portion of the connector.

The connector assembly also preferably includes a locking mechanism configured to interlock the C-shaped portion of the connector with the center member of the mounting member. The locking mechanism includes a bolt, and a bore defined by the center member of the mounting member and adapted to receive the bolt. The connector assembly further includes a lock for securing the mounting member to the T-post. The lock includes a body having an inner cavity formed therein shaped to receive the T-post, and an outer contour configured to fixedly engage the stem of the mounting member. The connector assembly may also include a means for carring an electrofiable fence wire for providing electricity to the fence.

A yet further embodiment of the invention relates to a hinge for connecting at least one rail-receiving connector to a T-post. The hinge includes a stem having a channel formed therein shaped to receive the T-post, and a center member projecting from the stem and configured to pivotally mount the connector to the T-post about at least one axis. Preferably, the hinge permits the connector to pivot about a horizontal and a vertical axis, but not about a longitudinal axis. The center member of the hinge preferably has an outer surface with a substantially spherical curvature.

Another embodiment of the invention relates to a connector for connecting a rail to a hinge on a T-post. The connector includes a rail-receiving portion at one end of the connector configured to receive the rail, and a C-shaped portion at the other end of the connector configured to be mounted to the hinge.

DETAILED DESCRIPTION

Figure 1:
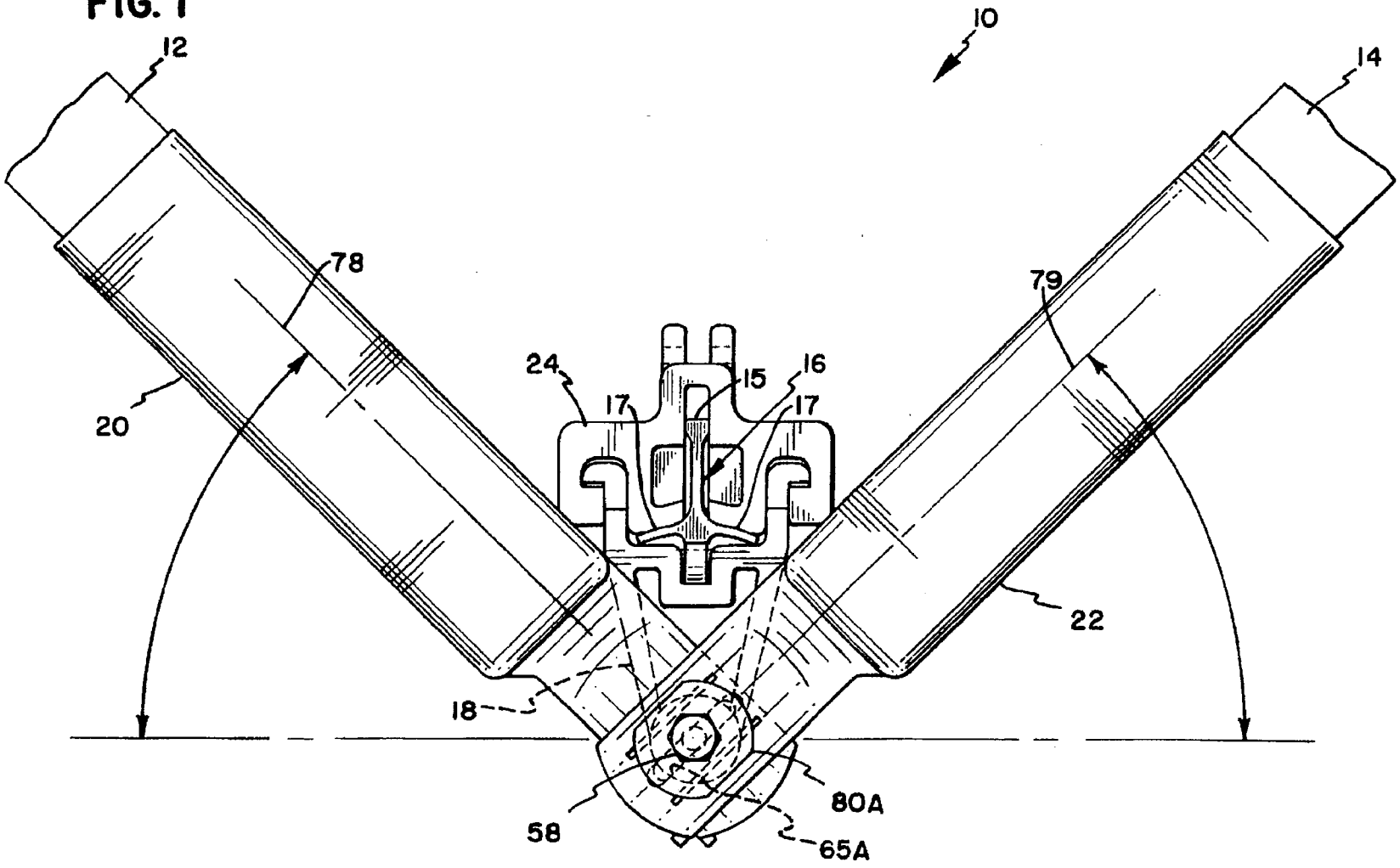
FIG. 1 shows a top plan view of one preferred embodiment of a connector assembly.
Figure 1A:
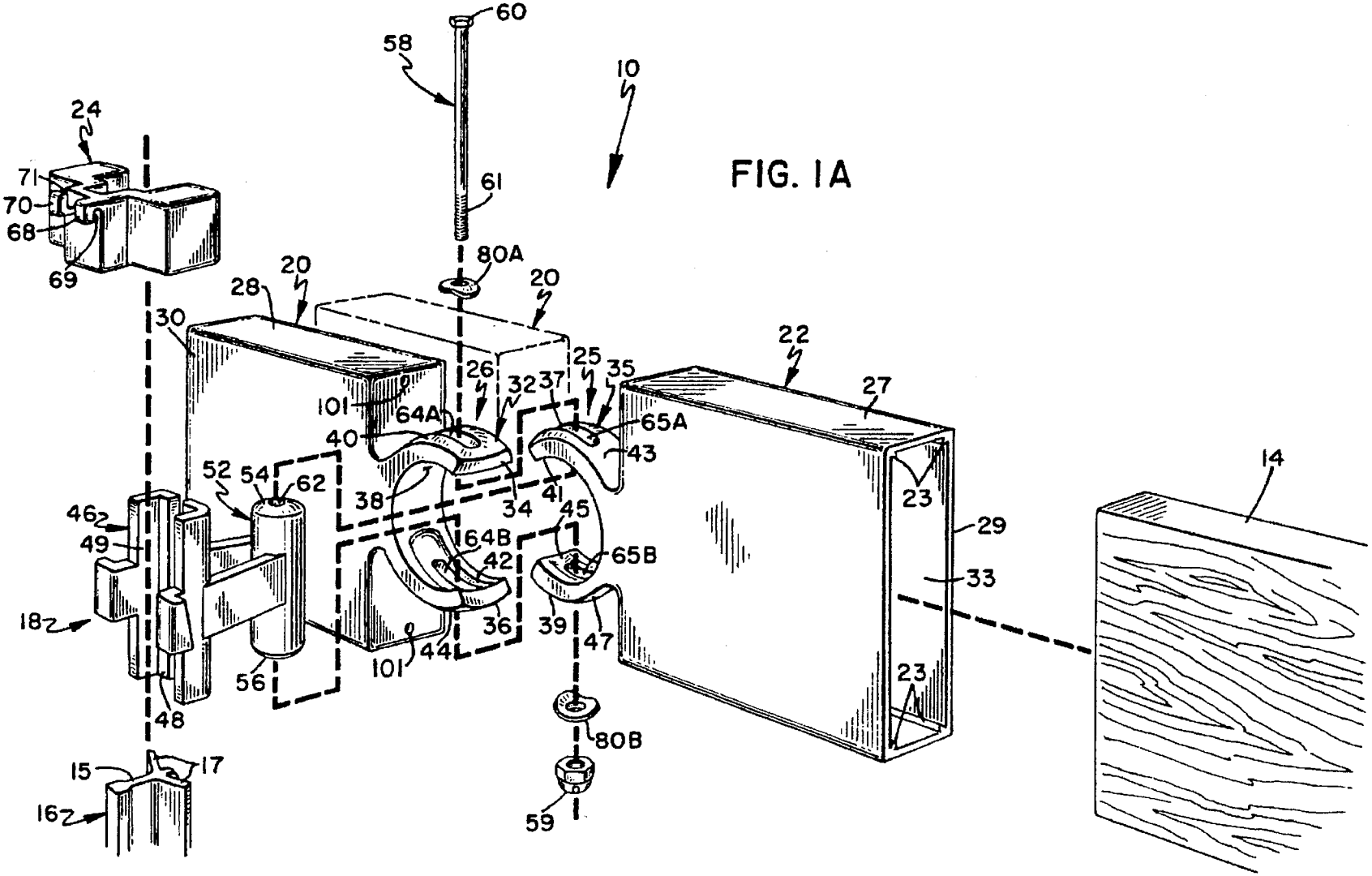
FIG. 1A is a perspective, exploded view of the connector assembly of FIG. 1.

FIG. 1 shows one embodiment of a connector assembly 10 in accordance with the present invention. As can be seen from FIG. 1, the connector assembly 10 is being used to connect two rails, rails 12 and 14, to a post 16, to form a fence (not shown). It can be appreciated, however, that a fencing system was chosen merely for illustrative purposes. Connector assembly 10 may be used in other applications such as, for example, connecting the side walls of a house to the roof, or for providing structural support to a tent or canopy.

Specifically, rails 12 and 14 are connected to post 16, such as a T-post, via a mounting member 18, and a first and second connector 20 and 22, respectively the post 16 is formed with intersecting flanges 15 and 17 best seen in FIG 1. The rails may be made of a variety of materials, including wood or plastic. First and second connectors 20 and 22 are each adapted to receive rails 12 and 14, respectively, at one end, and to pivotally mount rails 12 and 14 to mounting member 18 at the other end. Mounting member 18 is configured to permit first connector 20 and second connector 22 to pivot about at least one axis with respect to post 16. For example, as is shown in FIG. 1, first and second connectors 20 and 22 are pivoted about in axis substantially parallel to post 16. A lock 24 provides a securing means for securing mounting member 18 to post 16. The mounting member 18 and the lock 16 collectively comprise a mounting means for mounting the connector to the post. Each of these components will be described in further detail below.

FIGS. 2A–2E show one embodiment of the connectors as shown in FIG. 1. First and second connectors 20 and 22 are shown to have a generally rectangular shape. In a preferred embodiment, first and second connectors 20 and 22 are shaped to receive rails having any of the following dimensions: 1"×4", 1"×6", 2"×4", and 2"×6". The shape of first and second connectors 20 and 22, however, is not critical and may be altered to accommodate rails having other dimensions. First and second connectors 20 and 22 may be suitably formed such as by injection molding of a thermoplastic material.

Moreover, first connector 20 need not have the same shape as second connector 22. However, in a preferred embodiment, first and second connectors 20 and 22 are identical so that they can be easily interchanged. For example, by rotating first connector 20 as shown in FIG. 2A 180 degrees, it in essence becomes second connector 22 as shown in FIG. 2C. This feature helps reduce manufacturing costs since one mold can produce both connectors. For the purposes of further discussion, however, it will be assumed that first connector 20 and second connector 22 are identical.

With reference to FIG. 2A, first connector 20 has an inner end 26, a sleeve 28, and an outer end 30. Outer end 30 has an opening 31 adapted to receive rail 12. Sleeve 28 is shaped to frictionally engage rail 12. It can be appreciated, however, that rail 12 may be mounted to first connector 20 in a number of ways, such as by screws. Preferably, opening 31 is only slightly larger than rail 12 in order to provide support to rail 12 at outer end 30. It can be appreciated, however, that opening 31 and sleeve 28 can be adapted so that rails of various shapes and sizes may be inserted therein. In this manner, first connector 20 need not be customized to fit a particular sized rail.

In a preferred embodiment, sleeve 28 may also be configured with a plurality of openings 101 to provide a draining mechanism to prevent water from accumulating within first connector 20. With this feature, the risk of rail 12 swelling and eventually breaking or rotting is minimized. To further minimize the effects of swelling, sleeve 28 also preferably includes a plurality of projection members 23 projecting from the inner peripheral of the chamber inside of sleeve 28 as is shown in FIG. 2F. Projection members 23 provide a swelling area 19 which rail 12 may occupy in the event swelling occurs. While the size of swelling area 19 is not critical, it preferably provides approximately a ¼ inch space between the rail and the inside surface of sleeve 28.

Inner end 26 of sleeve 28 is configured to mount onto mounting member 18 (see FIG. 1). Preferably, inner end 26 has a C-shaped portion 32 having a top section 34 and a bottom section 36. It is not essential, however, that the shape of inner end 26 of sleeve 28 be C-shaped. Rather, any shaped inner end which can frictionally engage and pivotally mount to mounting member 18 may be used.

Figure 2B:
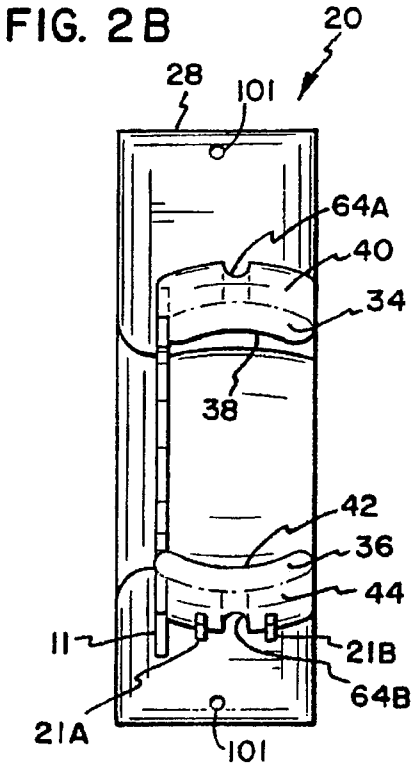
FIG. 2B shows a front elevational view of the left connector of FIG. 2A.
Figure 2A:
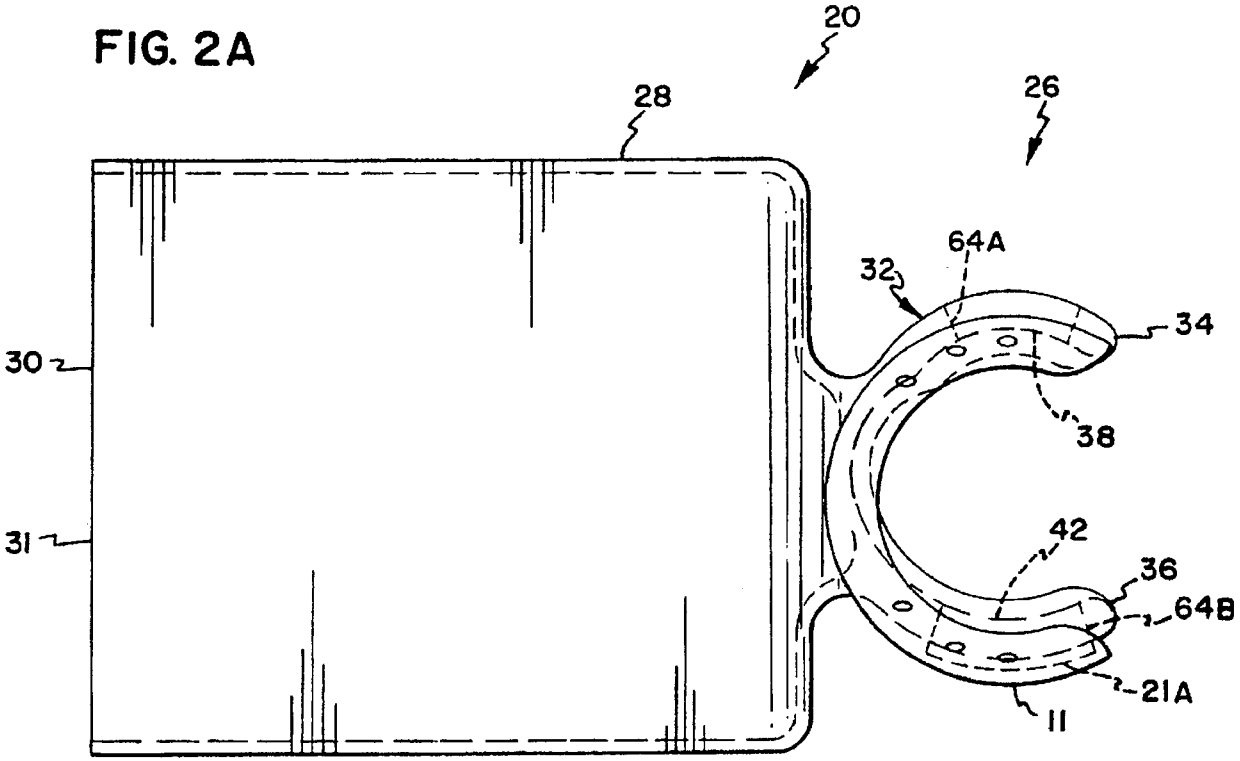
FIG. 2A shows a left side elevational view of the left connector of FIG. 1.
Figure 2C:
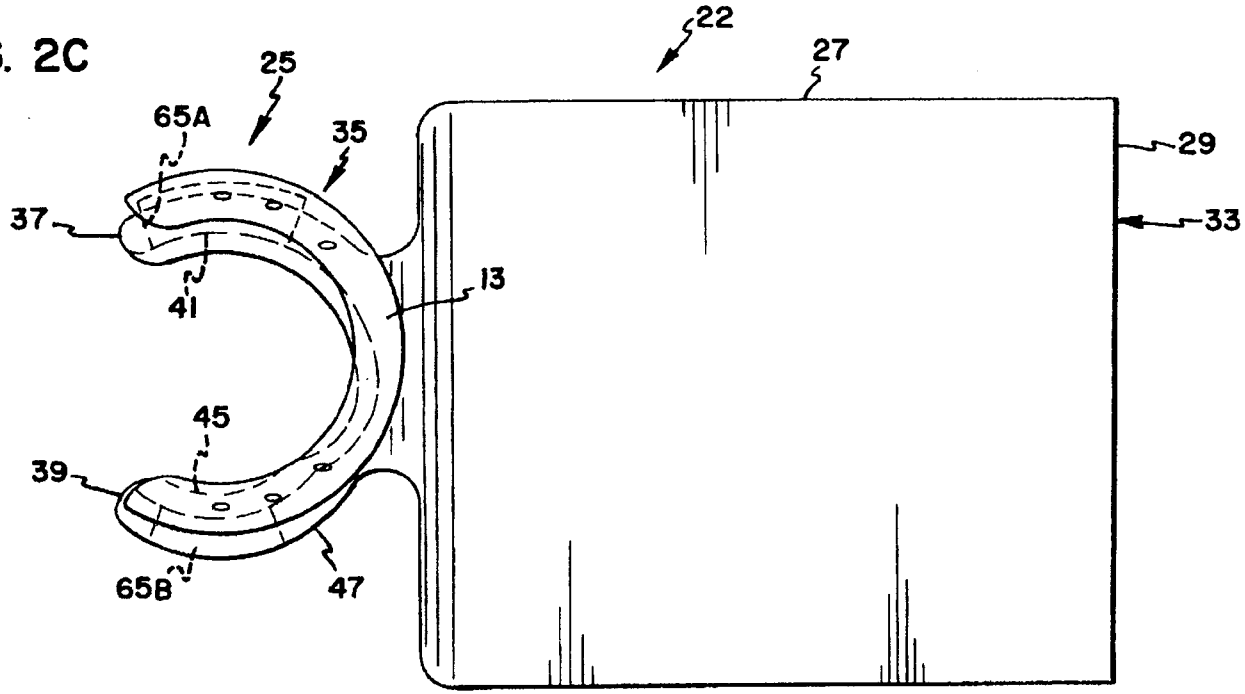
FIG. 2C shows a right side elevational view of the right connector of the connector assembly of FIG. 1.

As shown in FIG. 2B, top section 34 has an inner surface 38 and an outer surface 40. Bottom section 36 also has an inner surface 42 and an outer surface 44. Preferably, the curvature of top section 34 is substantially the same as the curvature of bottom section 36. The shape of these surfaces depends on the shape of center member 52 upon which it is mounted, as well as the manner in which first and second connectors 20 and 22 are configured, as will later be explained in further detail.

Inner end 26 of sleeve 28 may also be provided with a horseshoe overlay 11 for attaching to the front side of C-shaped portion 32 (see FIG. 2B). However, horseshoe overlay 11 is provided merely for aesthetic purposes and has no functional utility.

With respect to FIG. 2C, second connector 22 has an inner end 25, a sleeve 27, and an outer end 29. Outer end 29 has an opening 33 adapted to receive rail 14. Sleeve 27 is shaped to frictionally engage rail 14. It can be appreciated, however, that rail 14 may be mounted to second connector 22 in a number of ways, such as by screws. Preferably, opening 33 is only slightly larger than rail 12 in order to provide support to rail 14 at outer end 29. It can be appreciated, however, that opening 33 and sleeve 27 can be adapted so that rails of various shapes and sizes may be inserted therein. In this manner, second connector 22 need not be customized to fit a particular sized rail.

In a preferred embodiment, sleeve 27 may also be configured with a plurality of openings (not shown) to provide a draining mechanism to prevent water from accumulating within second connector 22. With this feature, the risk of rail 14 swelling and eventually breaking or rotting is minimized. As with sleeve 28, sleeve 27 may also be provided with a plurality of projection members projecting from the inside thereof for providing a swelling area which rail 14 may occupy in the event swelling occurs (not shown).

Inner end 25 of sleeve 27 is configured to mount onto mounting member 18 (see FIG. 1). Preferably, inner end 25 consists of a C-shaped portion 35 having a top section 37 and a bottom section 39. It is not essential, however, that the shape of inner end 25 of sleeve 27 be C-shaped. Rather, any shaped inner end which can frictionally engage and pivotally mount to mounting member 18 may be used.

Figure 2E:
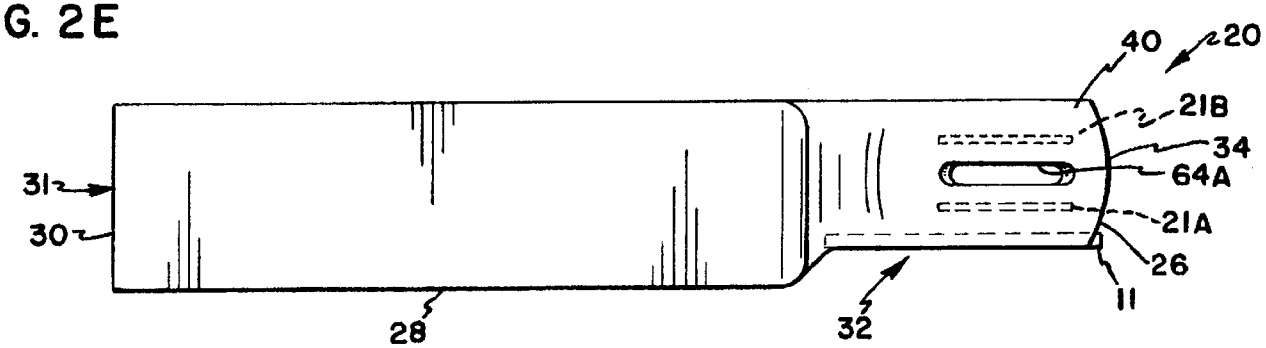
FIG. 2E shows a top plan view of the left connector of FIG. 2A.
Figure 2F:
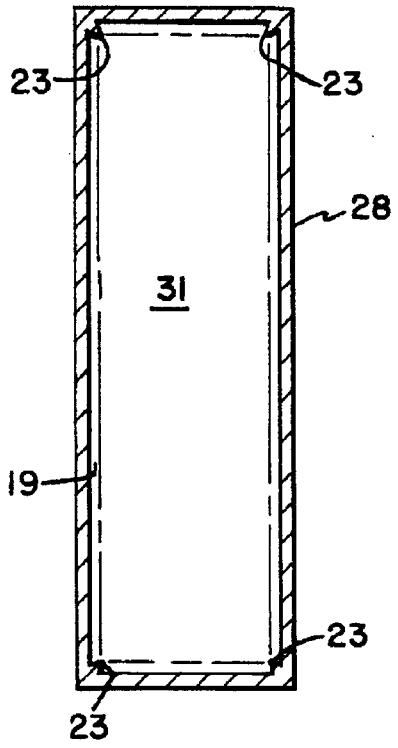
FIG. 2F shows a front cross-sectional view of a preferred embodiment of the left connector as shown in FIG. 2A.
Figure 2D:
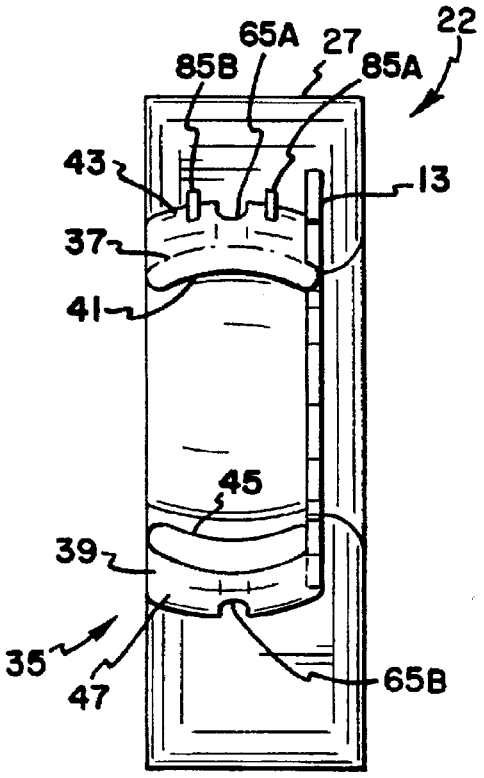
FIG. 2D shows a front plan view of the right connector of FIG. 2C.

As shown in FIG. 2D, top section 37 has an inner surface 41 and an outer surface 43. Bottom section 39 also has an inner surface 45 and an outer surface 47. Preferably, the curvature of top section 37 is substantially the same as the curvature of bottom section 39. The shape of these surfaces depends on the shape of center member 52 upon which it is mounted, as well as the manner in which first and second connectors 20 and 22 are configured, as will later be explained in further detail.

Inner end 25 of sleeve 27 may also be provided with a horseshoe overlay 13 for attaching to the front side of C-shaped portion 35 (see FIG. 2D). However, horseshoe overlay 13 is provided merely for aesthetic purposes and has no functional utility.

Figure 4A:
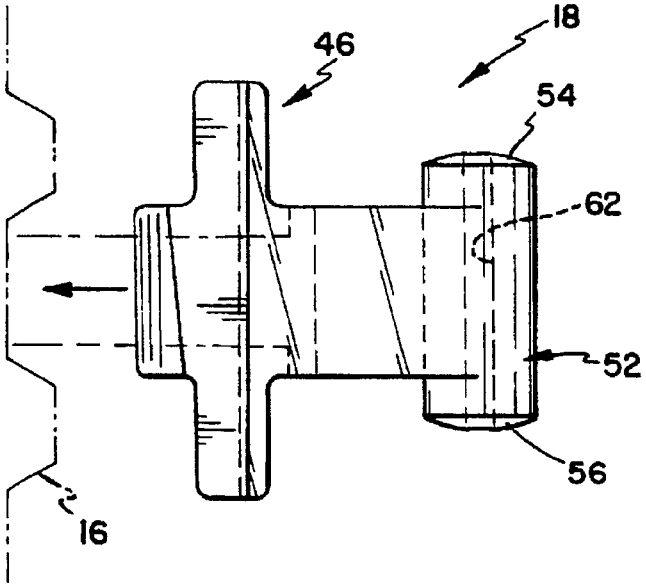
FIG. 4A shows a left side elevational view of a mounting member of the connector assembly of FIG. 1.
Figure 4B:
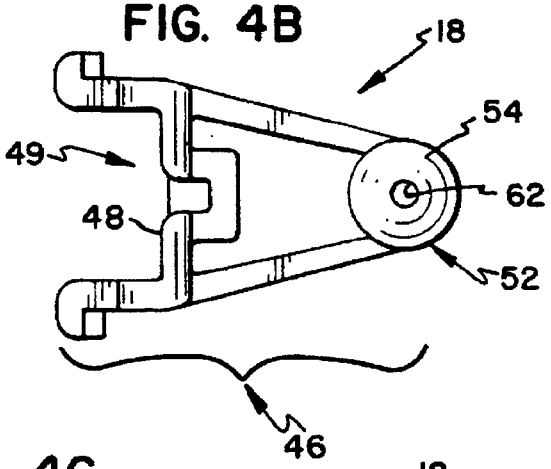
FIG. 4B shows a top plan view of the mounting member of FIG. 4A.
Figure 4C:
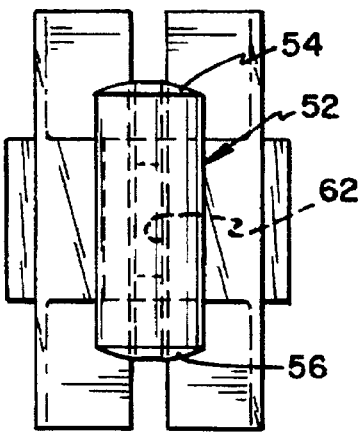
FIG. 4C shows a front elevational view of the mounting member of FIG. 4A.

With reference to FIGS. 4A–4C, mounting member 18 includes a stem 46 and a center member 52 performed of an elongated segment from stem 46 at a substantially right angle to the stem. As can best be seen in FIG. 4B, stem 46 has a channel 48 formed therein which is shaped to receive post 16 and lock 24. (See FIG. 1). The stem has an access gap 49 through which post 16 is received in channel 48. Center member 52 preferably spherical. However, any shape which allows first connector 20 and second connector 22 to pivot about at least one axis when mounted to mounting member 18 may be used. Any changes in the shape of center member 52, however, must be accompanied by appropriate changes in the shape of inner surfaces 38 and 42 of C-shaped portion 32 of first connector 20, and of inner surfaces 41 and 45 of C-shaped portion 35 of second connector 22.

Referring back to FIG. 4A, center member 52 has an upper surface 54 and lower surface 56. Upper surface 54 has substantially the same curvature as that of inner surface 38 of first connector 20 or inner surface 41 of second connector 22, while lower surface 56 has substantially the same curvature as that of inner surface 42 of first connector 20 or inner surface 45 of second connector 22. In this manner, first and second connectors 20 and 22 may be mounted to center member 52 in various configurations.

Figure 3:
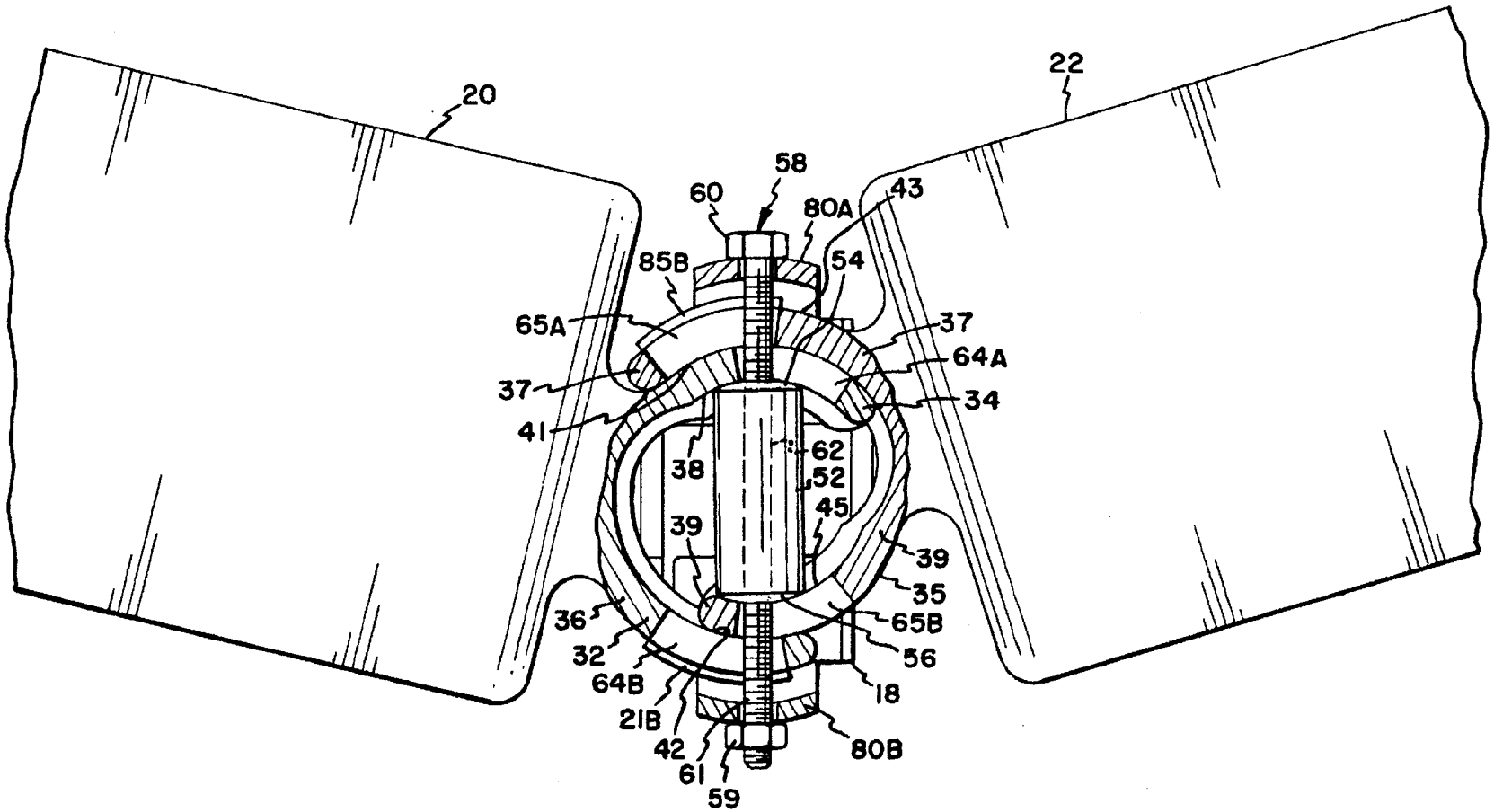
FIG. 3 shows a front plan view of the right and left connectors and the mounting member of FIG. 1.

In one configuration, the top and bottom sections of first and second connectors 20 and 22 overlap, respectively, so that the top section 37 of second connector 22 is outermost while the bottom section 36 of first connector 20 is outermost (see FIG. 3). Alternatively, the top and bottom sections of first and second connectors 20 and 22 can overlap such that top section 34 of first connector 20 is outermost, while bottom section 39 of second connector 22 is outermost. In another configuration, top and bottom sections 34 and 36 of first connector 20 may be rested within top and bottom sections 37 and 39 of second connector 22 (not shown). Alternatively, top and bottom sections 37 and 39 of second connector 22 may be rested within top and bottom sections 34 and 36 of first connector 20 (not shown). These configurations will now be discussed in detail below.

As can best be seen in FIG. 3, C-shaped portions 32 and 35 of first and second connectors 20 and 22, respectively, are designed to frictionally engage mounting member 18. When assembled, top section 34 of first connector 20 is held between center member 52 of mounting member 18 and top section 37 of second connector 22, while bottom section 39 of second connector 22 is held between center member 52 of mounting member 18 and bottom section 36 of first connector 20. In order to achieve frictional engagement and yet allow for pivotal movement of C-shaped portions 32 and 35 about mounting member 18, outer surface 40 of top section 34 has substantially the same curvature as inner surface 41 of top section 37 (see FIG. 2D), outer surface 47 of bottom section 39 (see FIG. 2D) has substantially the same curvature as that of inner surface 42 of bottom section 36 (see FIG. 2B), and inner surface 38 of top section 34 and inner surface 45 of bottom section 39 have substantially the same curvature as upper surface 54 and lower surface 56 of center member 52,respectively (see FIG. 2B).

Alternatively, top section 37 of second connector 22 may be held between center member 52 of mounting member 18 and top section 34 of first connector 20, while bottom section 36 of first connector 20 is held between center member 52 of mounting member 18 and bottom section 39 of second connector 22 (not shown). In order to achieve frictional engagement and yet allow for pivotal movement of C-shaped portions 32 and 35 about mounting member 18, outer surface 43 of top section 37 has substantially the same curvature as inner surface 38 of top section 34, outer surface 44 of bottom section 36 has substantially the same curvature as inner surface 45 of bottom section 39, and inner surface 41 of top surface 37 and inner surface 42 of bottom section 36 have substantially the same curvature as upper surface 54 and lower surface 56 of center member 52, respectively.

In another embodiment, both top section 34 and bottom section 36 of C-shaped portion 32 of first connector may be held between center member 52 of mounting member 18 and top section 37 and bottom section 39 of second connector 22, respectively (not shown). In order to achieve frictional engagement and yet allow pivotal movement of C-shaped portions 32 and 35 about mounting member 18, outer surface 40 of top section 34 has substantially the same curvature as inner surface 41 of top section 37, outer surface 44 of bottom section 36 has substantially the same curvature as inner surface 45 of bottom section 39, and inner surface 38 of top section 34 and inner surface 42 of bottom section 36 have substantially the same curvature as upper surface 54 and lower surface 56 of center member 52, respectively.

In yet another alternative configuration, both top section 37 and bottom section 39 of second connector 22 may be held between center member 52 of mounting member 18 and top section 34 and bottom section 36 of first connector 20, respectively (not shown). In order to achieve frictional engagement and yet allow for pivotal movement of C-shaped portions 32 and 35 about mounting member 18, outer surface 43 of top section 37 has substantially the same curvature as inner surface 38 of top section 34, outer surface 47 of bottom section 39 has substantially the same shape as the curvature of inner surface 42 of bottom section 36, and inner surface 41 of top section 37 and inner surface 45 of bottom section 39 have substantially the same shape as the curvature of upper surface 54 and lower surface 56 of center member 52, respectively.

As is further shown in FIG. 3, connector assembly 10 may also be provided with a locking mechanism, such as a bolt 58 for interlocking C-shaped portions 32 and 35 of first connector 20 and second connector 22, respectively. Bolt 58 has a head 60 and a threaded shaft 61. Center member 52 of mounting member 18 is provided with a bore 62 for receiving shaft 61 of bolt 58 (see FIGS. 4A and 4B). The diameter of bore 62 is preferably only slightly larger than the diameter of bolt 58 to prevent mounting member 18 from moving.

As is shown in FIGS. 2A, 2C, and 2E, C-shaped portions 32 and 35 of first and second connector 20 and 22, respectively, are adapted to receive bolt 58. In particular, top section 34 and bottom section 36 of C-shaped portion 32 are provided with a pair of slots, slots 64A and 64B, while top section 37 and bottom section 39 of C-shaped portion 35 are provided with a pair of slots, slots 65A and 65B, for receiving bolt 58 when first and second connector 20 and 22 are mounted onto center member 52 of mounting member 18. Each of the elongated slots 64A and 64B have their longest dimension parallel to the plane 78 (FIG. 1) defined by the C of C-Shaped portion 32. Similarly the elongated slots 65A and 65B have their longest dimension parallel to the plane 79 (FIG. 1) defined by the C of the C-shaped portion 35. A nut 59 is provided for attaching to the end of shaft 61 to secure bolt 58 in place. Preferably, the length of shaft 61 is such that only a nominal portion of shaft 61 extends beyond nut 59 to prevent injury to animals that may run onto the connector assembly.

Figure 6A:
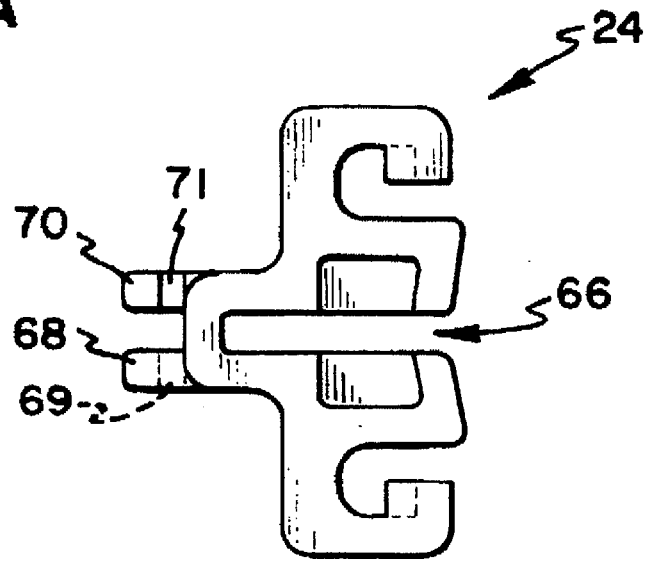
FIG. 6A is a top plan view of a lock useable with the connector assembly of FIG. 1.
Figure 6B:
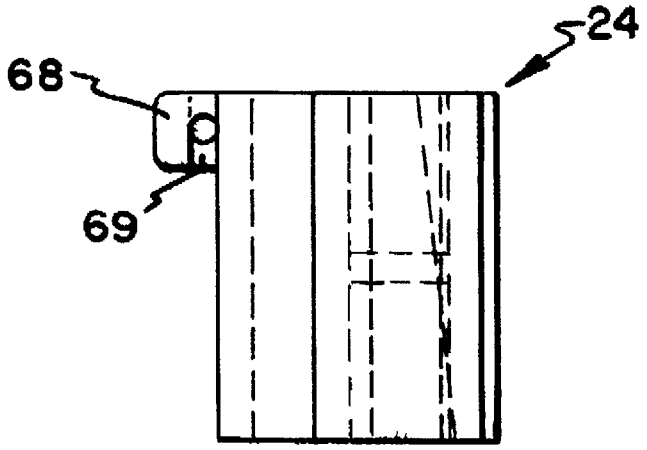
FIG. 6B is a left side elevational view of the lock of FIG. 6A.
Figure 7:
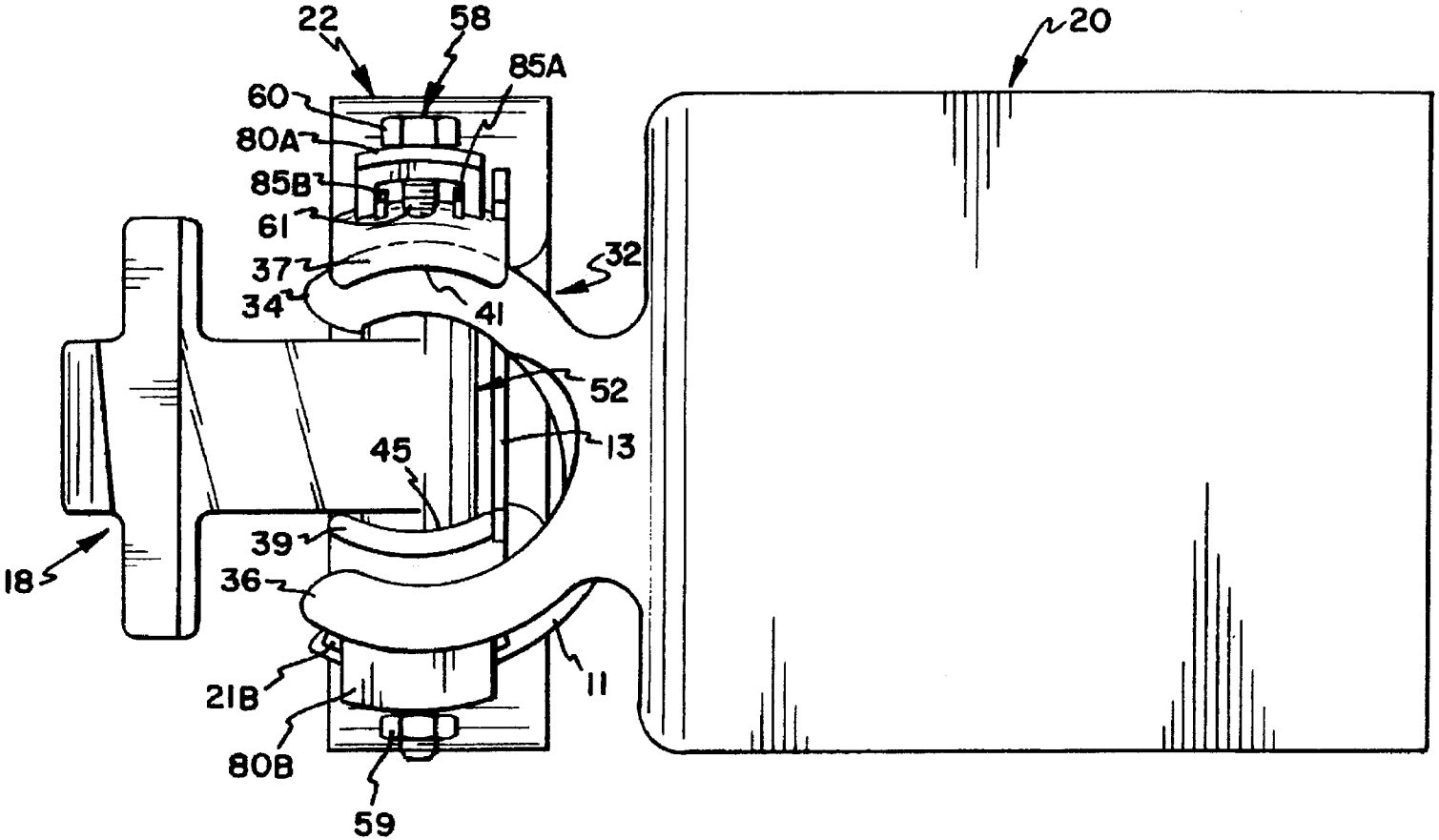
FIG. 7 shows an elevational view of the connector assembly FIG. 1 with the connectors mounted at right angles with respect to each other.

Slots 64A and 64B, and slots 65A and 65B are preferably elongated to allow pivotal movement of C-shaped portions 32 and 35 with respect to mounting member 18 about at least one axis. Preferably, first and second connectors 20 and 22 can pivot at least 15° about the horizontal axis of post 16 in either direction, so that the rails can be positioned on uneven terrains (see FIG. 6). More preferably, as shown in FIG. 7, first and second connectors 20 and 22 can also pivot about the vertical axis of post 16 so as to form at least a 90° inside corner between first connector 20 and second connector 22, as well as to form at most a 90° outside corner between first connector 20 and second connector 22 (See FIG. 1). FIG. 7 shows first connector 20 and second connector 22 at right angles (90°) with respect to each other. Movement of first and second connectors 20 and 22 in the vertical direction, however, is preferably independent from movement of first and second connectors 20 and 22 in the horizontal direction. With such a configuration, a multi-directional fencing system can be achieved.

In a preferred embodiment, connector assembly 10 also preferably includes a set of washers 80A and 80B. Washer 80A is configured to fit between the head 60 of bolt 58 and the outer surface 40 of top section 34 of first connector 20, or the outer surface 43 of top section 37 of second connector 22, depending on the manner in which first and second connector 20 and 22 are configured. Washers 80A and 80B provide structural reinforcement to the top and bottom sections of first and second connectors 20 and 22, as well as minimize the pressure applied thereto by nut 59 and head 60. As a result, the risk of the top and bottom sections of first and second connectors 20 and 22 breaking is minimized.

Accordingly, as can be seen in FIGS. 2B and 2E, connector 20 may be provided with two ribbed portions 21A and 21B aligned with and surrounding slot 64B onto which washer 80B (see FIG. 3) attaches. As is shown in FIG. 2D, connector 22 may similarly be provided with two ribbed portions 85A and 85B aligned with and surrounding slot 65A onto which washer 80A attaches. It can be appreciated, however, that the placement of the ribs may vary depending on how first and second connectors 20 and 22 are configured. In general, ribs should be provided on the outermost sections of the C-shaped portions of first and second connectors 20 and 22. In the case of a single connector, ribs are preferably provided on both the top and bottom sections of the C-shaped portion.

Referring back to FIG. 1, lock 24 locks mounting member 18 to post 16. With reference to FIGS. 6A and 6B, lock 24 has a body with an inner cavity 66 formed therein which is shaped to receive post 16. The outer contour of the body of lock 24 is configured to receive and attach to stem 46 of mounting member 18. Lock 24 is preferably a self-tightening lock which, with the movement of connector assembly 10, continuously tightens mounting member 18 to post 16 to prevent movement thereof.

The body of lock 24 may also provide electrical hook-up to connector assembly 10. Accordingly, as is shown in FIG. 6A, a first finger 68 and a second finger 70 project from the back of locking mechanism 24 and are spaced apart to receive an electrical wire (not shown) from a substantially vertical position therebetween. First finger 68 and second finger 70 also have a slot 69 and 71, respectively, in alignment with each other (see FIG. 6B) to run the wire in a substantially horizontal direction therethrough. The wire may then be run along the rails attached thereto along a plurality of connector assemblies.

Figure 5:
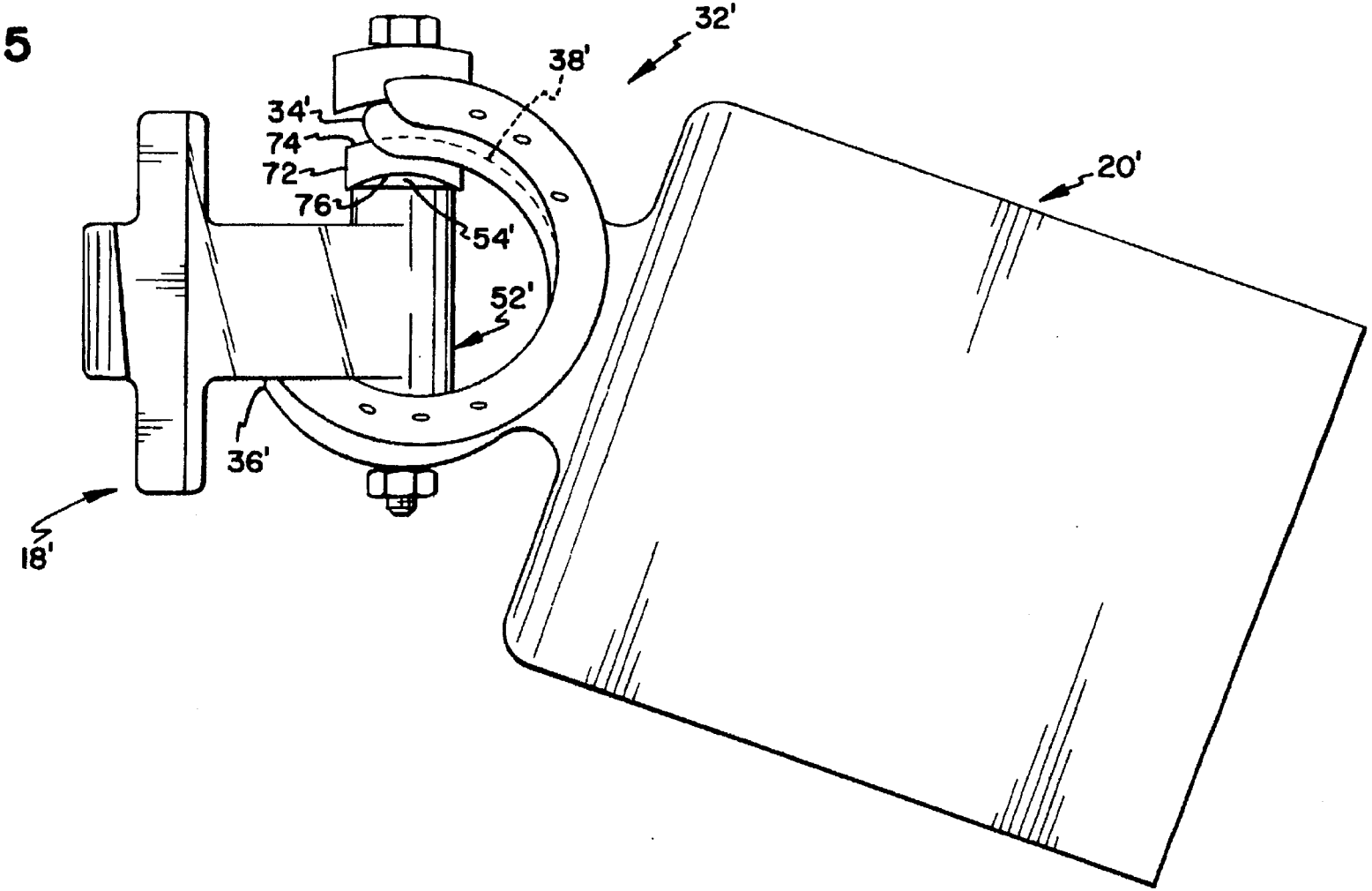
FIG. 5 is a right side elevational view of the connector assembly of FIG. 1, with only one connector.

Mounting member 18 may also be used to connect only one connector to post 16, for example, at the start or the end of a fencing system. As is shown in FIG. 5, a spacer 72 is inserted between top section 34' of C-shaped portion 32' and center member 52' of mounting member 18' to allow C-shaped portion 32' to frictionally engage center member 52' of mounting member 18'. Alternatively, spacer 72 can be inserted between bottom section 36' of C-shaped portion 32' and center member 52' of mounting member 18'. Alternatively, a connector having a top and bottom section which can by themselves frictionally engage center member 52' without the aid of a spacer may be used (not shown).

Spacer 72 may have a top surface 74 having a curvature substantially the same as the curvature of inner surface 38' of top section 34' of C-shaped portion 32'. Likewise, spacer 72 may have a bottom surface 76 having a curvature substantially the same as the curvature of the surface 54' of center member 52'. Alternatively, where washer 72 is inserted between bottom section 36' and center member 52', top surface 74 may have substantially the same curvature as the inner surface 42' of bottom section 36', while bottom surface 76 may have a curvature substantially the same as the curvature of the surface 54' of outer member 52' (not shown). When assembled, the pivotal movement of connector 20', as previously described herein with respect to two connectors mounted to mounting member 18, may be achieved.

It should be apparent that the foregoing description is only illustrative of the invention and is not intended to limit the scope of the coverage. Various changes to the form, details, arrangement, and proportions of the disclosed parts may be made without departing from the spirit of the invention as claimed in the following claims.

What is claimed is:

1. A connector assembly for connecting a rail having a longitudinal axis to a post, comprising:

a connector having a rail-receiving portion at one end configured to receive the rail;

mounting means attachable to the post for pivotally mounting said connector to the post about at least one axis;

said connector including a C-Shaped portion;

said mounting means including:

a stem having a channel formed therein shaped to receive the post;

a center member projecting from said stem, said center member configured to frictionally engage said C-Shaped portion of said connector; and said center member having a surface with a substantially spherical curvature; and said C-shaped portion of said connector including an inner surface having a curvature substantially the same as said curvature of said center member.

2. The connector assembly of claim 1 wherein:

said mounting means further includes a locking mechanism configured to interlock said C-shaped portion of said connector with said center member;

said locking mechanism including a bolt and a bore, said bore passing through said center member and adapted to receive said bolt; and said C-shaped portion of said connector including a top and a bottom section, said top and bottom sections each having a centrally located elongated slot adapted to receive said bolt.

3. The connector assembly of claim 2 wherein said mounting means permits said connector to pivot about a horizontal axis and a vertical axis, said connector is structured to prevent rotation of the rail about the longitudinal axis of the rail when the rail is engaged with said rail receiving portion, and said elongated slot having its longest dimension parallel to the plane defined by the C of said C-shaped portion.

4. A connector assembly usable for connecting first and second rails to a post, comprising:

a first connector having a rail-receiving portion at one end configured to receive the first rail;

a second connector having a rail-receiving portion at one end configured to receive the second rail;

each of said first and second connectors including a C-shaped portion; mounting means attachable to the post, said mounting means including:

a stem having a channel formed therein shaped to receive the post;

a center member projecting from said stem and configured to frictionally engage said C-shaped portions of said first and second connectors; and said center member including a surface with a substantially spherical curvature; and said first and second connectors being pivotally mounted to said mounting means for movement about at least one axis; and said C-shaped portions of said first and second connectors each including a top section having an inner and outer surface and a bottom section having an inner and outer surface, said inner and outer surfaces of said top and bottom sections each having a curvature which is substantially the same as said curvature of said center member of said mounting means.

5. The connector assembly of claim 4 wherein, when assembled, said top section of said second connector is held between said top section of said first connector and said center member of said mounting means, and said bottom section of said first connector is held between said bottom section of said second connector and said center member of said mounting means.

6. The connector assembly of claim 5, wherein said mounting means further comprises:

a locking mechanism configured to interlock said C-shaped portions of said first and second connectors with said center member of said mounting means.

7. The connector assembly of claim 6, wherein said locking mechanism comprises:

a bolt having a head; and a bore defined by said center member of said mounting means and adapted to receive said bolt.

8. The connector assembly of claim 7, wherein said top and bottom sections of said C-shaped portions of said first and second connectors each have a centrally located elongated slot communicating with one another and adapted to receive said bolt therethrough.

9. The connector assembly of claim 8, further comprising a washer held between said head of said bolt and said top section of said first or second connector.

10. The connector assembly of claim 4, wherein, when assembled, said top section of said first connector is held between said top section of said second connector and said center member of said mounting means, and said bottom section of said second connector is held between said bottom section of said first connector and said center member of said mounting means.

11. A connector assembly for connecting a rail to a post, comprising:

a connector having a rail-receiving portion at one end, and a C-shaped portion at the other end, said C-shaped portion having a top section and a bottom section; and mounting means attachable to the post for pivotally mounting said C-shaped portion of said connector to the post for movement about at least one axis, said mounting means comprising:

a stem having a channel formed therein and shaped to receive the post;

a center member projecting from said stem and having a surface with a substantially spherical curvature; and a washer having a top surface and a bottom surface, said top and bottom surfaces of the washer each having a curvature substantially the same as the curvature of said center member and wherein, when assembled, said washer is held between said center member of said mounting means and said top section or said bottom section of said C-shaped portion.

12. The connector assembly of claim 11, further comprising a locking mechanism configured to interlock said C-shaped portion of said connector with said center member of said mounting means.

13. The connector assembly of claim 11, wherein said locking mechanism comprises:

a bolt; and a bore defined by said center member of said mounting means and adapted to receive said bolt.

14. The connector assembly of claim 11, further comprising means for securing said mounting means to the post.

15. The connector assembly of claim 14, wherein said means for securing comprises a body having an inner cavity formed therein shaped to receive the post, and an outer contour configured to fixedly engage said stem of said mounting means.

16. The connector assembly of claim 11, further comprising a means for mounting a conductive wire to said connector assembly.

17. The connector assembly of claim 11 wherein said rail has a longitudinal axis and said mounting means permits said connector to pivot about a horizontal axis and a vertical axis, but prevents pivoting of said connector about the longitudinal axis of the rail when the rail is contained by said connector.

18. A connector assembly for connecting a rail to a post comprising:

a connector having a rail receiving portion at one end configured to receive the rail;

mounting means attachable to the post for pivotally mounting said connector to the post about at least one axis;

said connector including a C-shaped portion;

said mounting means including:

a stem having a channel formed therein shaped to receive the post;

a center member projecting from said stem; and a spacer positioned between said C-shaped portion of said connector and said center member, wherein when assembled, said C-shaped portion of said connector frictionally engages said center member of said mounting means and is permitted to pivot about at least one axis with respect to said post.

19. A connector assembly for connecting a rail to a post, comprising:

a connector having inner and outer ends, having a rail-receiving portion at said outer end configured to receive the rail, and a C-shaped portion at said inner end;

a mounting means attachable to the post for pivotally mounting said connector to the post about at least one axis, said mounting means including:

a stem having a channel formed therein, said channel shaped to receive the post;

a center member projecting from said stem, said center member configured to frictionally engage said C-shaped portion of said connector; and said center member having a first surface with a substantially spherical curvature; and said C-shaped portion of said connector including a first inner surface having a curvature substantially the same as said curvature of said first surface of said center member.

20. The connector assembly of claim 19 wherein:

said center member further includes a second surface having a spherical curvature substantially the same as said first surface of said center member;

said C-shaped portion further includes a second inner surface having a curvature substantially the same as said curvature of said second surface of said center member; and said first and second inner surfaces of said C-shaped portion frictionally engage said first and second center member surfaces, respectively, to allow pivoting of said C-shaped portion relative to said center member.

21. The connector assembly of claim 20 wherein said center member includes an elongated segment having upper and lower ends and oriented generally parallel to the post when said connector assembly is installed on the post, and said first and second center member spherical surfaces are located on said upper and lower ends of said elongated segment.

22. The connector assembly of claim 21 wherein the length of said elongated segment is substantially equal to the distance separating said inner surfaces of said C-shaped portion.

23. The connector assembly of claim 22 wherein said elongated segment is oriented at a substantially right angle to said stem.

24. The connector assembly of claim 20 wherein said mounting means further includes a spacer having upper and lower surfaces having curvatures substantially the same as said first surface of said center member and shaped to nest between said center member and said C-shaped portion.

25. The connector assembly of claim 19 wherein the rail has a longitudinal axis and said mounting means, when mounted on the post, permits said connector to pivot about a horizontal axis and a vertical axis, and is structured to prevent rotation of the rail about the longitudinal axis of the rail when the rail is engaged with said rail-receiving portion.

26. The connector assembly of claim 19 wherein:

said mounting means further includes a locking mechanism configured to interlock said C-shaped portion of said connector with said center member;

said locking mechanism including a bolt and a bore, said bore passing through said center member and adapted to receive said bolt;

said C-shaped portion of said connector including a top section and a bottom section, said top and bottom sections each having a centrally located elongated slot adapted to receive said bolt; and each said elongated slot having its longest dimension parallel to the plane defined by the C of said C-shaped portion.

27. The connector assembly of claim 19 wherein said mounting means further includes means for carrying a fence wire, the wire aiding in discouraging animals from destructive leaning on the wire, and the rail providing high visibility needed to prevent accidental collision between the animals, rail and wire.

28. The connector assembly of claim 19 wherein:

said C-shaped portion has an upper section and a lower section;

said center member contacts one of said sections, and said mounting means further includes a spacer positioned between the other of said sections of said C-shaped portion and said center member, wherein when assembled, said C-shaped portion of said connector frictionally engages said spacer and said center member of said mounting means and is permitted to pivot about at least one axis with respect to the post.

29. A connector assembly usable for connecting first and second rails to a post, comprising:

a first connector having inner and outer ends, with a rail-receiving portion at said outer end configured to receive the first rail;

a second connector having inner and outer ends, with a rail-receiving portion at said outer end configured to receive the second rail;

each of said first and second connectors including a C-shaped portion at said inner end;

mounting means attachable to the post and including a stem having a channel formed therein shaped to receive the post;

said first and second connectors being pivotally mounted to said mounting means for movement about at least one axis;

said mounting means further including a center member projecting from said stem and configured to frictionally engage said C-shaped portions of said first and second connectors;

said center member including a first surface with a substantially spherical curvature; and said C-shaped portions of said first and second connectors each including a top section having an inner and outer surface and a bottom section having an inner and outer surface, said inner surfaces of said top and bottom sections each having a curvature which is substantially the same as said spherical curvature of said first surface of said center member of said mounting means.

30. The connector assembly of claim 29 wherein:

said center member further includes a second surface having a curvature substantially the same as said curvature of said first surface of said center member; and said inner surfaces of said first and second C-shaped portions of said first and second connectors frictionally engaging said first and second center member surfaces to allow pivoting of said C-shaped portions relative to said center member.

31. The connector assembly of claim 30 wherein said center member includes an elongated segment having upper and lower ends and oriented generally parallel to the post when said connector assembly is installed on the post, and said first and second center member spherical surfaces are located on said upper and lower ends of said elongated segment.

32. The connector assembly of claim 31 wherein, when assembled, said top section of said first connector is held between said top section of said second connector and said center member of said mounting means, and said bottom section of said second connector is held between said bottom section of said first connector and said center member of said mounting means.

33. The connector assembly of claim 32 wherein said elongated segment is oriented at a substantially right angle to said stem.

34. The connector assembly of claim 29, wherein, when assembled, said top section of said first connector is held between slid top section of said second connector and said center member of said mounting means, and said bottom section of said second connector is held between said bottom section of said first connector and said center member of said mounting means.

35. The connector assembly of claim 34, wherein said mounting means further comprises:

a locking mechanism configured to interlock said C-shaped portions of said first and second connectors with said center member of said mounting means.

36. The connector assembly of claim 35, wherein said locking mechanism comprises:

a threaded bolt having a head, a bore extending within and through said center member of said mounting means and adapted to receive said bolt; and a nut threadable on said bolt;

said bolt passing through said C-shaped members of said first and second connectors and through said bore, and said nut threaded on said bolt.

37. The connector assembly of claim 36, wherein said top and bottom sections of said C-shaped portions of said first and second connectors have centrally located elongated slots communicating with one another and adapted to receive said bolt therethrough.

38. The connector assembly of claim 37, further comprising a washer held between said head of said bolt and said top section of one of said connectors.

39. The connector assembly of claim 35 wherein:

said mounting means further including means for carrying a fence wire, the wire aiding in discouraging animals from destructive leaning on the wire, and the rail providing high visibility needed to prevent accidental collision between animals, rail and wire.

40. The connector assembly of claim 29, said mounting means further including a locking mechanism configured to interlock said C-shaped portions of said connectors with said center member of said mounting means.

41. The connector assembly of claim 40, wherein said locking mechanism comprises:

a bolt; and a bore defined by said center member of said mounting means and adapted to receive said bolt.

42. The connector assembly of claim 29 wherein each rail has a longitudinal axis and wherein said mounting means also permits said connector to pivot about a second axis positioned at a right angle to said first axis, but prevents pivoting of said connector about the longitudinal axis of the rail.

43. The connector assembly of claim 29 wherein each of said top and bottom sections of said C-shaped portions includes an elongated slot, the said elongated slots of said first and second connector top sections communicating and the said elongated slots of said first and second connector bottom sections communicating.

44. The connector assembly of claim 43 wherein said mounting means includes a locking mechanism having a bolt, a nut, and a bore defined by said center member, said bore being adapted to receive said bolt, and wherein said bolt extends through said elongated slots of said top and bottom sections of said C-shaped portions and through said bore, said nut being tightened on said bolt to frictionally engage said C-shaped portions against said center member.

45. The connector assembly of claim 44 wherein:

said bolt includes a head; and said mounting means further including upper and lower washers, said upper washer positioned between said head and the top section of said first connector, and said lower washer positioned between said nut and said bottom section of said second connector.

46. The connector assembly of claim 45 wherein each said washer has a curved surface contacting the said C-shaped portion adjacent to the washer.

47. The connector assembly of claim 29 wherein:

said mounting means includes a mounting member in which said stem, channel, and center member are formed; and said mounting means further includes securing means releaseably, lockably engaging said mounting member to trap the post between said mounting member and said securing means and rigidly retain said mounting means on the post.

48. The connector assembly of claim 47 wherein:

said securing means includes a body having an inner cavity formed therein and shaped to receive the post, and said body further includes an outer contour configured to attach to said stem.

49. The connector assembly of claim 29 wherein said first and second connectors are molded from thermoplastic material and are identical and interchangeable.

50. The connector assembly of claim 29 wherein said inner and outer surfaces of said upper and lower sections of said first and second C-shaped portions have the same radius of curvature as measured within the plane defined by each said C-shaped portion.

51. The connector assembly of claim 50 wherein the radius of curvature of all surfaces having substantially spherical curvature being equal to said radius of curvature of said inner and outer surfaces of said upper and lower sections of said C-shaped portions.

52. A hinge for connecting a rail to a post, comprising:

a connector with a C-shaped portion and a rail receiving portion configured to receive the rail;

mounting means attachable to the post and pivotally mounting said connector for swinging movement about at least one axis;

said mounting means including a stem having a channel formed therein said channel shaped to receive the post and further including a center member projecting from said stem and configured to frictionally engage said C-shaped portion of said connector;

said center member having a surface with a substantially spherical curvature; and said C-shaped portion of said connector including an inner surface having a curvature substantially the same as said curvature of said center member of said mounting means.

53. A connector assembly attachable to a non-tubular post, the post having at least two intersecting flanges, so as to connect an end of a rectangular cross-section rail with the post, comprising:

mounting means including a channel shaped to receive the flanges, said mounting means engagable with each of the intersecting flanges of the post to retain the mounting means on the flanges of the post;

a first connector carded by said mounting means, said connector being molded of thermoplastic material and having inner and outer ends, and said connector including a rail-receiving sleeve at said outer end, said sleeve having an interior rail receiving chamber with a rectangular cross-section to slideably, fictionally receive and carry the rail end of the rectangular cross-section rail within said chamber so as to surround the rail end and protect the end from damage;

said connector chamber having an inner periphery and said sleeve further including a plurality of projection members positioned within said chamber and projecting inward from said inner periphery to contact the rail and space the rail from said periphery to improve drainage of unwanted moisture and improve air circulation about the rail.

54. A connector assembly attachable to a non-tubular fence post, having a top and at least two intersecting flanges, for quickly connecting the end of a rectangular cross-section rail with the post at any vertical height on the post without the need to insert the top of the post into said connector assembly and then lower said connector assembly along the post, comprising:

mounting means including a mounting member having a channel therein with an access gap in said channel to allow said channel to laterally receive the post through said gap when said channel is pressed laterally against the post, said mounting means further including a lock releasably engageable with said mounting member to frictionally engage the flanges of the post between said mounting member and said lock;

a connector movably mounted to said mounting means and having a rail-receiving portion configured to receive the rail, said rail-receiving portion including a sleeve having a rectangular cross-section interior chamber to frictionally, slideably receive and carry the end of the rectangular cross-section rail within said chamber;

said movably mounted connector being pivotally mounted to said mounting means for swinging movement about at least a first axis.

55. The connector assembly of claim 54 wherein said connector is swingably mounted for movement relative to said mounting means about a second axis positioned at a substantially right angle to said first axis.

56. The connector assembly of claim 55 wherein said connector chamber has an inner periphery and said sleeve further includes a plurality of projection members positioned within said chamber and projecting inward from said inner periphery to contact and space the rail from said periphery to improve drainage of unwanted moisture and improve air circulation about the rail.

57. The connector assembly of claim 55 wherein said sleeve further includes a plurality of openings passing therethrough to define a draining mechanism to allow escape of unwanted moisture from within said sleeve.

58. The connector assembly of claim 55 wherein said connector includes a C-shaped portion with the C defining a plane, such plane being oriented substantially parallel to the post when said assembly is mounted to the post.

59. A connector assembly mountable to a post and said assembly useable with a fence wire and a rectangular cross-section rail for containment of animals, comprising:

mounting means attachable to the post;

a connector carried by said mounting means and having a rail carrying portion configured to carry the rail;

said connector assembly further including means for carrying a fence wire;

the wire aiding in discouraging animals from destructive leaning on the wire, and the rail providing high visibility needed to prevent accidental collision between animals, rail and wire;

said mounting means having a front and a rear, with the post being received between said front and rear, and wherein said connector is at the front of said mounting means and said means for carrying wire is at the rear of said mounting means; and said connector being at substantially the same elevation relative to said mounting means as said means for carrying wire so that when the post and rails are viewed from the front of said mounting means the rail obscures the wire from view to give the aesthetic appearance of a conventional rail fence instead of a wire fence.

60. A connector assembly mountable to a post having at least two intersecting flanges and said assembly usable with both a fence wire and a rectangular cross-section rail for containment of animals, comprising:

mounting means attachable to the post;

a connector carried by said mounting means and having a rail carrying portion configured to carry the rail;

said connector assembly further including means for carrying a fence wire;

the wire aiding in discouraging animals from destructive leaning on the wire, and the rail providing high visibility needed to prevent accidental collision between animals, rail and wire;

said mounting means further including a channel to receive the post, said mounting means closely engageable with the intersecting flanges of the post to retain the mounting means on the post; and said mounting means including a mounting member having said channel therein with an access gap in said channel to allow said channel to laterally receive the post through said gap when said channel is pressed laterally against said post, said mounting means further including a lock releaseably engageable with said mounting member to frictionally engage the post between said mounting member and said lock.

61. A connector assembly for connecting a rail with a support structure, comprising:

a connector having inner and outer ends and having a rail-receiving portion at said outer end configured to receive the rail;

mounting means attachable to the support structure for pivotally mounting said connector to the support structure about at least one axis;

said connector including a C-shaped portion;

said mounting means including:

a stem shaped to mount to the support structure;

a center member projecting from said stem, said center member configured to frictionally engage said C-shaped portion of said connector; and said center member having a surface with a substantially spherical curvature; and said C-shaped portion of said connector including an inner surface having a curvature substantially the same as said curvature of said center member.

62. A connector assembly for connecting a rail to a post, comprising:

a connector having a rail receiving portion at one end configured to receive the rail and having a C-shaped portion;

mounting means attachable to the post for pivotally mounting said connector to the post about at least one axis,.said mounting means including:

a stem having a channel formed therein shaped to receive the post;

a center member projecting from said stem and configured to frictionally engage said C-shaped portion of said connector; and a locking mechanism configured to interlock said C-shaped portion of said connector with said center member, said locking mechanism including a bolt, and a bore defined by said center member, said bore adapted to receive said bolt; and said C-shaped portion of said connector including a top section and a bottom section, said top and bottom sections each including a centrally located elongated slot adapted to receive said bolt.

63. A connector assembly attachable to a non-tubular post, the post having at least two intersecting flanges, so as to connect an end of a rectangular cross-section rail with the post, comprising:

mounting means including a channel shaped to receive the flanges, said mounting means engageable with each of the intersecting flanges of the post to retain the mounting means on the flanges of the post;

a first connector carded by said mounting means, said connector being molded of thermoplastic material and having inner and outer ends, and said connector including a rail-receiving sleeve at said outer end, said sleeve having an interior rail receiving chamber with a rectangular cross-section to slideably, fictionally receive and carry the rail end of the rectangular cross-section rail within said chamber so as to surround the rail end and protect the end from damage;

said mounting means including a mounting member having said channel therein and having an access gap to allow said channel to laterally receive the post through said access gap when said channel is pressed laterally against the post, said mounting means further including a lock releaseably engageable with said mounting member to frictionally engage flanges of the post between said mounting member and said lock.

64. The connector assembly of claim 63 and wherein said inner end of said connector is pivotally mounted to said mounting means for swinging movement about first and second axes, said axes being perpendicular to one another.

65. The connector assembly of claim 63 wherein said connector chamber has an inner periphery and said sleeve further includes a plurality of projection members positioned within said chamber and projecting inward from said inner periphery to contact the rail and space the rail from said periphery to improve drainage of unwanted moisture and improve air circulation about the rail.

* * * * *

UNITED STATES PATENT AND TRADEMARK OFFICE

CERTIFICATE OF CORRECTION

PATENT NO. : 5,653,546
DATED : August 5, 1997
INVENTOR(S) : Carol M. Cronkhite and Jeff A Trupe It is certified that error appears in the above-identified patent and that said Letters Patent is hereby corrected as shown below:

Column 4,
Line 36, the words “carrying” and “electrifiable” are misspelled.

Column 5,
Line 49, should read -- about an axis substantially parallel to post 16.”

Column 7,
Line 32, the word “performed” should be -- formed --.
Line 39, should read -- Center member 52 is preferably spherical --

Column 9,
Line 33, “Fig 6” should be -- Fig 3 --

Column 15,
Line 34, the word “slid” should be -- said --.

Signed and Sealed this

Twenty-eighth Day of January, 2003

JAMES E. ROGAN
*Director of the United States Patent and Trademark Office*